United States Patent [19]

Rudolph

[11] Patent Number: 4,481,882

[45] Date of Patent: Nov. 13, 1984

[54] DEVICE FOR ADJUSTING INK OR MOISTURE-APPLICATION ROLLS

[75] Inventor: Harald Rudolph, Leipzig, German Democratic Rep.

[73] Assignee: Veb Kombinat Polygraph "Werner Lamberz" Leipzig, Leipzig, German Democratic Rep.

[21] Appl. No.: 500,314

[22] Filed: Jun. 2, 1983

[30] Foreign Application Priority Data

Jun. 2, 1982 [DD] German Democratic Rep. ..... 2403864

[51] Int. Cl.[3] ..... B41L 31/34; B41L 31/36; B41L 7/40; B41K 25/16

[52] U.S. Cl. ..... 101/148; 101/352

[58] Field of Search ..... 101/349, 350, 351, 352, 101/207-210, 148, 247, 218, 137, 139, 140, 143, 144, 145, 182

[56] References Cited

U.S. PATENT DOCUMENTS

| | | | |
|---|---|---|---|
| 3,902,417 | 9/1975 | Fischer | 101/148 |
| 4,130,057 | 12/1978 | List et al. | 101/352 |
| 4,397,237 | 8/1983 | Makosch | 101/352 |

*Primary Examiner*—J. Reed Fisher

*Attorney, Agent, or Firm*—Michael J. Striker

[57] ABSTRACT

A device for adjusting ink or moisture-application rolls to a feeding roll and a printing cylinder in a printing machine, which includes two eccentrics positioned on the shaft of the feeding roll and provided with radially extended rods pivotally connected to the piston rods of pneumatic working cylinders and two pivotable double-arm levers centrally positioned on the respective eccentrics and connected with their upper arms to the ink or moisture application rolls. Adjustment of the ink or moisture application rolls to the feeding roll is effected upon actuation of the working cylinder and rotation of the eccentrics and adjustment of the ink or moisture application rolls relative to the printing cylinder is effected upon the pivoting movement of the double-arm levers.

3 Claims, 3 Drawing Figures

DEVICE FOR ADJUSTING INK OR MOISTURE-APPLICATION ROLLS

BACKGROUND OF THE INVENTION

The present invention relates to a device for adjusting ink or moisture-application rolls which are usually utilized in offset printing machines. The utilization of the device is not, however limited to ink or moisture-application rolls of offset printing machines but can be also suggested for other printing machines where three rolls in a printing machine connected to each other are to be adjusted in a stepwise manner.

In known devices of the type under consideration the stopping, for example of the inking mechanism, takes place when the moisture-application roll is brought out of engagement with the printing cylinder but remains connected to a feeding roll. This has the disadvantage that ink residues from the printing cylinder get stuck to the moisture-application roll before water arrives thereon so that only a partial use of the water-transmitting roll results, and a moisture agent film on the moisture-transmitting roll is negatively affected. Furthermore, the known device has the disadvantage that during the stopping, the inking mechanism can be flattened on the rubber-coated moisture-application roll so that it can be so changed that the rolls would be separated from each other. It is known from German publication No. DE-OS2649003 disclosing the above described device that the moisture-applying device for printing machines, particularly offset printing machines, comprises an adjusting element-pair by which two groups of rolls can be engaged with or disengaged from each other. A precise adjustment of the rolls is obtained and due to a special arrangement of the adjusting device a satisfactory start of moisture agent transmission is possible. The disadvantage of this otherwise satisfactory arrangement is that the adjustment of the respective rolls to each other, e.g. the neighboring rolls to each other can not be independent from the respective positions of the neighboring rolls and the adjustment of one roll causes a change in adjustment of another roll.

SUMMARY OF THE INVENTION

It is an object of this invention to provide a device which avoids the above-noted disadvantages of conventional adjusting devices of ink or moisture-application rolls.

It is another object to provide an improved device of the foregoing type, which ensures a step-wise stopping of the moisture-application rolls.

To attain at these objects an adjusting device for moisture-application rolls is suggested in which the following adjusting steps are realized:

first step includes an adjustment of the moisture-application rolls with respect to a feeding roll; and second step involves an adjustment of the moisture-application roll, and thus of the whole moisture-applying mechanism, relative to a printing cylinder, in which step substantially the same components of the device are utilized but the reaction of the adjustment between the moisture-application roll and the feeding roll obtained in the first step is, during the second adjustment step, totally avoided; the stopping must be carried out in the analogous fashion with the same machine components.

Due to the invention there are provided definite stepwise start and stopping of the ink or moisture application roll.

The above noted objects of the invention are attained by a device for adjusting ink or moisture agent-application rolls in a printing machine including a printing cylinder and an inking or moisture-applying mechanism which includes a feeding roll for transmitting an ink or moisture to the agent-application rolls, wherein start and stopping of the inking or moisture-applying mechanism is carried out by a single positioning-element-pair, the adjusting device comprising a shaft carrying the feeding roll thereon; and adjusting means each corresponding to a respective agent-application roll, each adjusting means including an eccentric mounted on said shaft and having an elongated rod extended radially outwardly from said shaft, a working cylinder having a piston rod, said elongated rod being pivotally connected to said piston rod, said eccentric and said working cylinder adjusting a gap between said feeding roll and said agent application roll upon actuation of the working cylinder, a pivotable double-arm lever having an upper arm and a lower arm and coaxially positioned on said eccentric, said upper arm being connected to the respective agent-application roll and being formed with an adjustable stop which comes into contact with said elongated rod upon pivoting of said lever, a setting-screw means including a setting screw and a compression spring, and a stationary stop, said lower arm, upon pivoting of said lever, being movable between said stationary stop and contacting the latter during the adjusting of said gap between said agent-application roll and said feeding roll, and said setting screw when the force of said spring is overcome and said agent application-roll is adjusted relative to the printing cylinder whereby determined stepwise engagement with and disengagement of the agent-application roll from the feeding roll and the printing cylinder are effected.

According to a further feature of the invention a throttle can be arranged in a circuit of the pneumatic working cylinder for damping of a control velocity of the working medium in a conduit for air withdrawal connected to the working cylinder.

The important advantage of the invention is that a predetermined first adjustment step and a delayed second adjustment step are provided so that the ink or moisture application rolls have already been covered with the ink or moisture agent before the second step of adjusting the agent-application roll relative to the printing cylinder takes place. The adjustment of the gap between the agent application roll relative to the feeding roll is maintained during the second adjustment step because during the second adjustment step the eccentric and the double arm lever move cojointly and the eccentric is centrally positioned relative to the double-arm lever.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
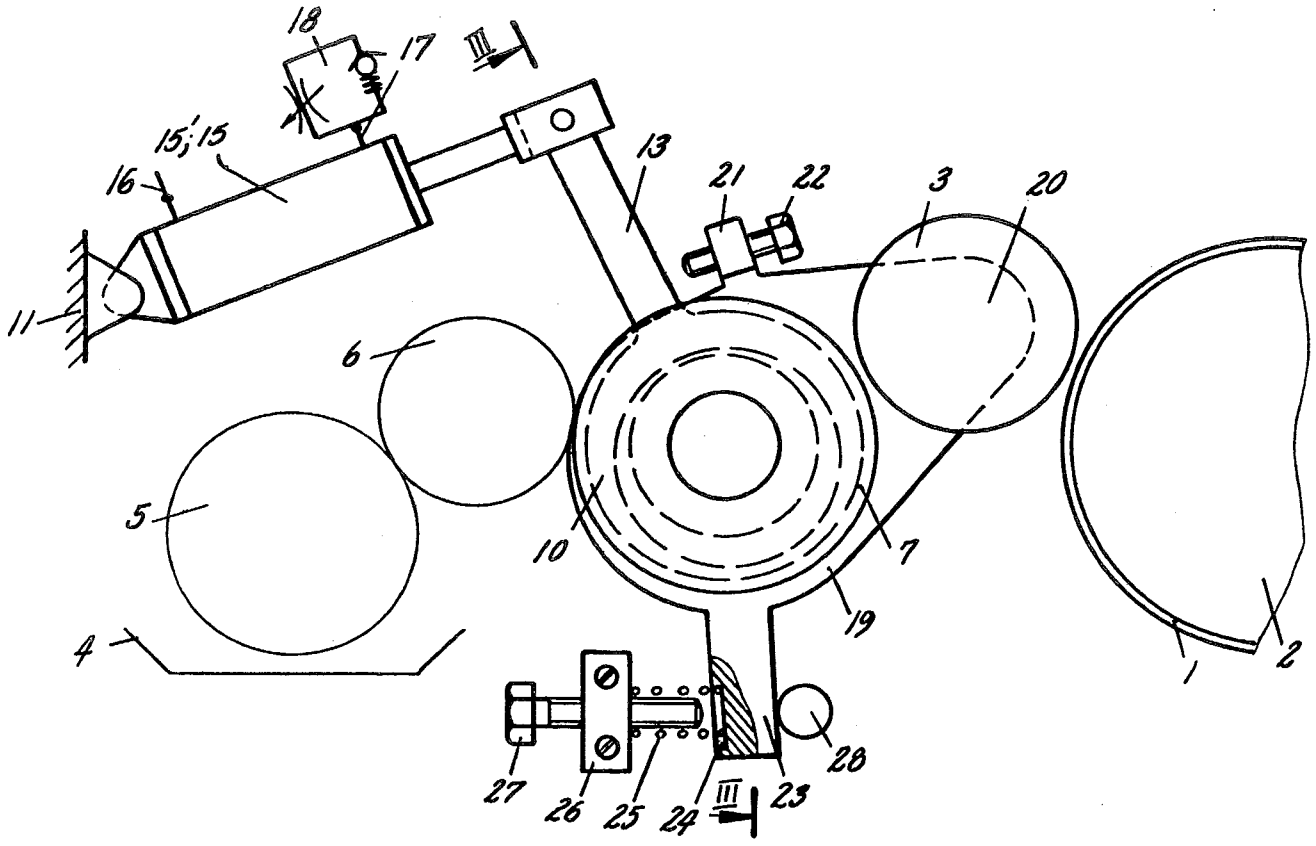
FIG. 1 is a schematic view of a moisture-applying device with an adjustable moisture-applying roll for a printing machine, according to the invention.
Figure 2:
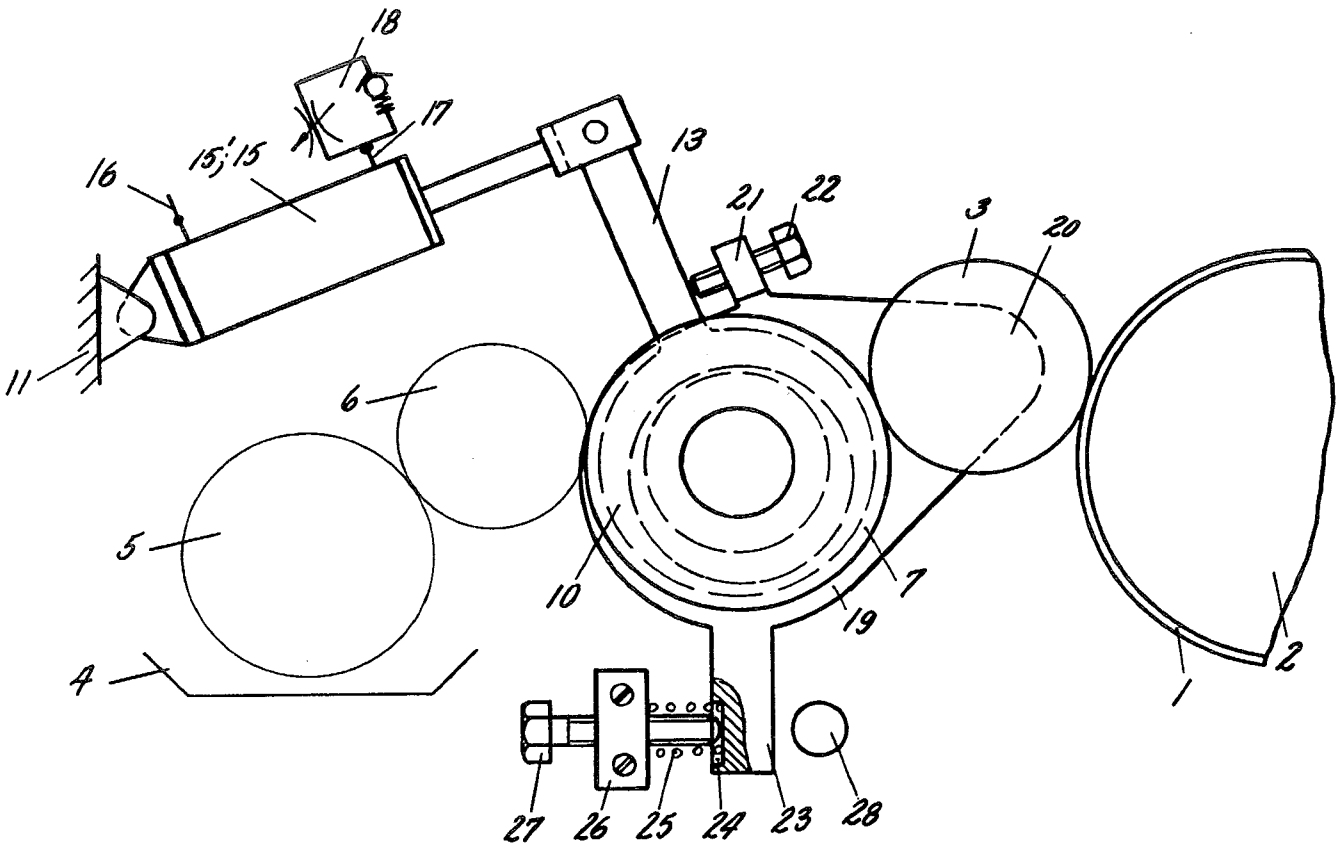
FIG. 2 is a schematic view similar to that of FIG. 1 but illustrating the moisture-applying roll in contact with a printing cylinder.

A printing plate 1 of a printing cylinder 2 is supplied with a moisture agent by means of a moisture-application roll 3. The moisture agent is contained in a container 4 from which it is transferred via a water-transmitting roll 5 and an intermediate roll 6 to a feeding roll 7 which can be also formed as a chatoyant form roller. Since the moisture-applying device is only a part of this invention it is described herein with respect to the feeding roll 7, moisture-application roll 3 and the printing cylinder 2.

Figure 3:
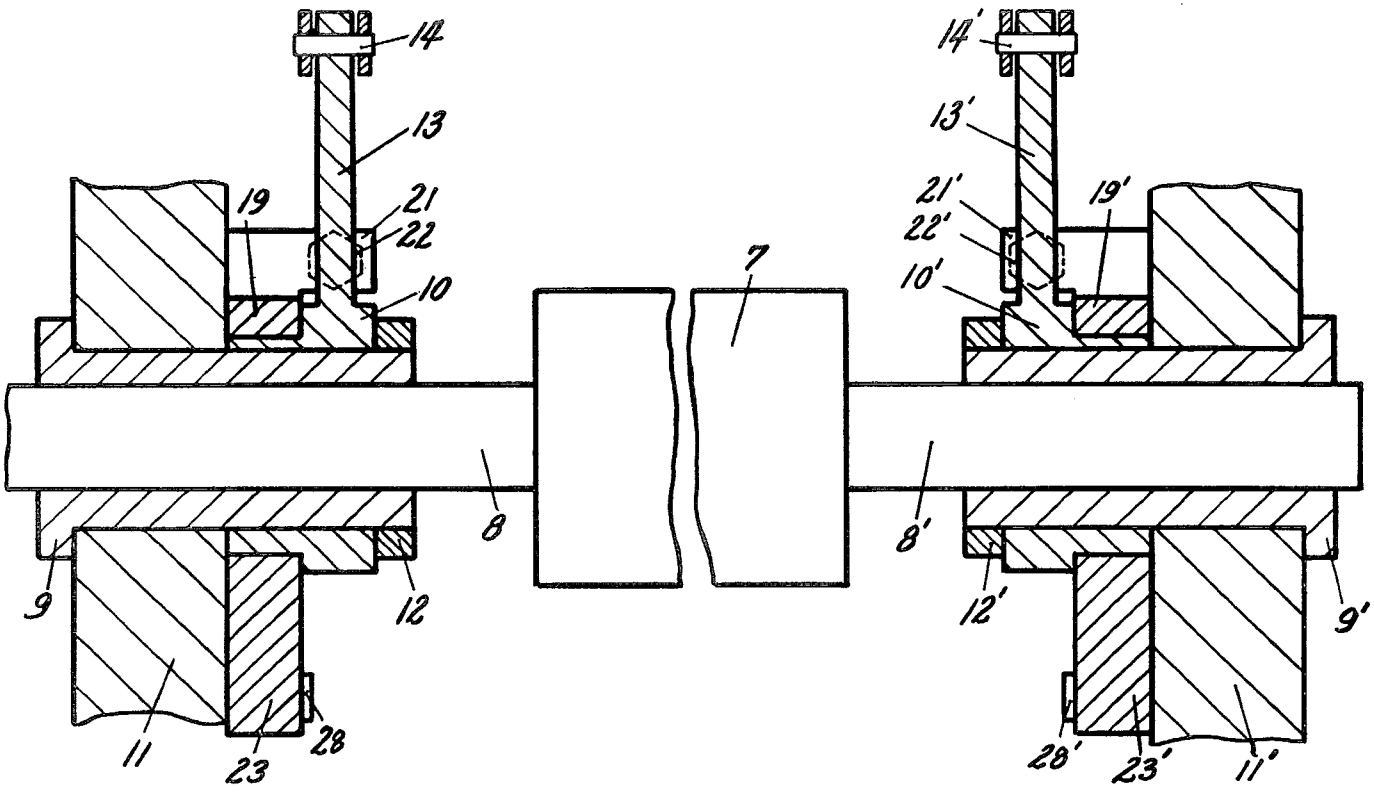
FIG. 3 is a partial sectional view on line III—III of FIG. 1.

With reference to FIG. 3 it will be seen that the feeding roll 7 is supported on a shaft 8 which includes two portions 8' and 8'' extended outwardly from roll 7 which can be designed integrally with portions 8' and 8'' of the shaft. Laterally of feeding roll 7 are positioned on shaft 8 two centric bushings 9 and 9' which surround portions 8' and 8'' of the shaft and are mounted coaxially therewith.

Reference characters 11 and 11' designate machine walls of the printing machine. Bushings 9 and 9' support thereon eccentrics 10 and 10', respectively. Each eccentric is arranged between respective machine wall 11, 11' and a respective adjusting ring 12, 12'. The eccentricity of the eccentrics 10 and 10' is within the range of the double-arm lever 19, 19', respectively. Rods 13 and 13' are rigidly connected to eccentrics 10 and 10', respectively. Rods 13, 13' are made integral with eccentrics 10, 10' in the preferred design.

With reference to FIGS. 1 and 3 it is seen that each rod 13 or 13' is connected to an assigned pneumatic working cylinder 15 or 15' particularly to the respective piston rod thereof by a pivot pin 14 or 14'. Each working cylinder is supplied with a pressure-generating means from an adjusting airsupply conduit 16 directly connected to the working cylinder. An adjustable air-withdrawal conduit 17 provided with an additional throttle 18 is also connected to the working cylinder 15 (15'). Both working cylinders 15 and 15' are pivotally supported to the machine walls 11, 11' as schematically shown in FIG. 1.

As shown in FIG. 1 eccentrics 10 and 10' each carries a double-arm lever 19 (19'). It is to be understood that for the sake of clarity only one double-arm lever 19 and only one eccentric 10 connected to the rod 13 cooperating with the working cylinder are shown in FIGS. 1 and 3. As clearly understood from FIG. 1 two eccentrics, two rods and two working cylinders, respectively, are arranged at both sides of the feeding roll 7.

The upper arms 20 and 20' of levers 19 receive through known bearings the moisture-application roll 3. Furthermore, a stop 21 (21') is provided on each upper arm 20 (20') which is adjustable by means of a screw 22 (22'). Stops 21, 21' and screws 22, 22' are also seen in FIG. 3.

The lower arms 23, 23' of levers 19, 19' are each formed with a recess 24 the base of which supports one end of a compression spring 25 the other end of which abuts against a screw-setting holder 26 of the screw-setting device known per se. Two screw-setting devices corresponding to two levers 19 and 19' are connected to the machine walls 11, 11', respectively. Each screw-setting arrangement has a setting screw 27. The movement of each lower arm 23, 23' is limited at the side thereof opposite to the screw-setting arrangement by a stop 28 (28') connected to the respective machine wall 11 (11'').

Upon admission of the pressurized air into working cylinders 15 and 15' an adjusting process is carried out in a following stepwise manner:

By means of actuation of throttles 18 in the air-withdrawal conduits 17 of the working cylinders 15, 15' will eccentrics 10 and 10' under the action of piston rods of the working cylinders rotate in the clockwise direction for a relatively long period of time. Double-arm levers 19 and 19' will nevertheless be maintained in the rest position by the action of compression springs 25 and 25'; in other words the rotation of the levers 19 and 19' will be at the beginning prevented from occurring so that each eccentric will merely effect a change in the distance between the shaft 8 and the bearing of the moisture-application roll 3. The roll 3 will thereby be brought toward the feeding roll 7 so that the moisture agent supplied from container 4 through rolls 5 and 6 to feeding roll 7 will be transmitted as a moisture agent-film to the roll 3. Lower arms 23, 23' of levers 19, 19' lie at this point of the process against the stops 28, 28' due to the pressure of compression springs 25, 25'. When the adjustment of the moisture-application roll 3 with respect to feeding roll 3 ends rods 13 and 13' of the eccentrics 10, 10' reach the contact surfaces of screws 22, 22' of adjustable stops 21, 21'; this effects the rotation of levers 19, 19' in the clockwise direction against the action of compression springs 25, 25' whereby the position of the moisture-application roll relative to the printing plate 1 of the printin cylinder 2 will be adjusted. This rotation ends when the lower arms 23, 23' come into contact with the ends of the setting screws 27, 27'.

For a stopping movement an adjusting air-withdrawal conduit 17, which has been up till now turned-off by throttle 18, will be now loaded with a pressurized air and the stopping process will be effected; in other words the moisture-application roll 3 will be first quickly separated from the printing plate 1 of the printing cylinder 2 and thereafter the lower arms 23 and 23' will again abut against stops 28 and 28 and the moisture-application roll 3 and feeding roll 7 will be again separated from each other in the above-described manner.

It will be understood that each of the elements described above, or two or more together, may also find a useful application in other types of devices for adjusting of ink and moisture-application rolls in the inking arrangements differing from the types described above.

While the invention has been illustrated and described as embodied in a device for adjusting of ink and moisture application rolls, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for adjusting ink or moisture agent application rolls in a printing machine including a printing cylinder and an inking or moisture-applying mechanism which includes a feeding roll for transmitting an ink or moisture to the agent-application rolls, the adjusting device comprising a shaft carrying the feeding roll thereon; and adjusting means each corresponding to a respective agent application roll, each adjusting means including an eccentric mounted on said shaft and having an elongated rod extended radially outwardly from said eccentric; a pneumatic working cylinder having a piston rod, said elongated rod being pivotally connected to said piston rod, said eccentric and said working cylinder adjusting a gap between said feeding roll and said agent application roll upon actuation of the working cylinder, a pivotable double-arm lever having an upper arm and a lower arm and coaxially positioned on said eccentric, said upper arm being connected to the respective agent application roll and being formed with an adjustable stop which comes into contact with said elongated rod upon pivoting of said lever; a setting-screw means including a setting screw located on a wall of said printing machine for coacting with one side of said lower arm, a compression spring positioned between said one side and said setting screw means; and a stationary stop on the other side of said lower arm; said lower arm, upon pivoting of said lever, being movable between said stationary stop and said setting screw; said lower arm contacting said stationary stop during the adjusting of said gap between said respective agent application roll and said feeding roll; said lower arm contacting said setting screw when the force of said spring is overcome and said agent-application roll is adjusted relative to the printing cylinder whereby determined stepwise engagement with and disengagement of the agent application roll from the feeding roll and the printing cylinder are effected.

2. The device as defined in claim 1, wherein said working cylinder includes an adjusting air-withdrawal conduit provided with throttling means for slowing down a control velocity of a working medium in said working cylinder.

3. A device for adjusting two ink or moisture agent application rolls in a printing machine including a printing cylinder and an inking or moisture-applying mechanism which includes a feeding roll for transmitting an ink or moisture to the agent application rolls, the adjusting device comprising a shaft carrying the feeding roll thereon; and two adjusting means positioned at opposite sides of the feeding roll and each corresponding to the respective agent application roll, each adjusting means including an eccentric mounted on said shaft and having an elongated rod extended radially outwardly from said eccentric, a pneumatic working cylinder having a piston rod, said elongated rod being pivotally connected to said piston rod, said eccentric and said working cylinder adjusting a gap between said feeding roll and said agent application roll upon actuation of the working cylinder, a pivotable double-arm lever having an upper arm and a lower arm and coaxially positioned on said eccentric, said upper arm being connected to the respective agent application roll and being formed with an adjustable stop which comes into contact with said elongated rod upon pivoting of said lever, a setting-screw means including a setting screw located on a wall of said printing machine for coacting with one side of said lower arm, a compression spring positioned between said one side and said setting screw means; and a stationary stop on the other side of said lower arm, said lower arm, upon pivoting of said lever, being movable between said stationary stop and said setting screw; said lower arm contacting said stationary stop during the adjusting of said gap between said respective agent-application and said feeding roll; said lower arm contacting said setting screw when the force of said spring is overcome and said agent-application roll is adjusted relative to the printing cylinder whereby determined stepwise engagement with and disengagement of the agent application roll from the feeding roll and the printing cylinder are effected.

* * * * *